US006524369B1

(12) United States Patent
Krigmont

(10) Patent No.: US 6,524,369 B1
(45) Date of Patent: Feb. 25, 2003

(54) MULTI-STAGE PARTICULATE MATTER COLLECTOR

(76) Inventor: Henry V. Krigmont, 3600 Marigold St., Seal Beach, CA (US) 90740

( * ) Notice: Subject to any disclaimer, the term of this patent is extended or adjusted under 35 U.S.C. 154(b) by 0 days.

(21) Appl. No.: 09/950,157

(22) Filed: Sep. 10, 2001

(51) Int. Cl.[7] ..... B03C 3/155; B03C 3/36

(52) U.S. Cl. ..... 95/78; 55/341.1; 55/372; 96/59; 96/62; 96/73; 96/87; 96/97

(58) Field of Search ..... 96/55, 59, 62, 96/70, 73, 79, 86, 87, 97; 95/70, 78; 55/341.1, 361, 372

(56) References Cited

U.S. PATENT DOCUMENTS

| | | | | | |
|---|---|---|---|---|---|
| 1,345,790 | A | * | 7/1920 | Lodge | 96/62 |
| 1,356,462 | A | * | 10/1920 | Nesbit | 96/87 |
| 2,654,438 | A | * | 10/1953 | Wintermute | 96/62 |
| 3,915,676 | A | | 10/1975 | Reed et al. | 55/432 X |
| 4,147,522 | A | | 4/1979 | Gonas et al. | 55/467 X |
| 4,354,858 | A | | 10/1982 | Kumer et al. | 55/DIG. 5 |
| 4,357,151 | A | | 11/1982 | Helfritch et al. | 55/302 X |
| 4,375,364 | A | * | 3/1983 | Van Hoesen et al. | 96/87 |
| 4,411,674 | A | | 10/1983 | Forgal | 55/304 |
| 4,904,283 | A | | 2/1990 | Hovis et al. | 96/66 |
| 5,024,681 | A | | 6/1991 | Chang | 95/70 |
| 5,066,313 | A | * | 11/1991 | Mallory, Sr. | 95/57 |
| 5,158,580 | A | | 10/1992 | Chang | 95/70 |
| 5,217,511 | A | | 6/1993 | Plaks et al. | 55/334 X |
| 5,547,493 | A | | 8/1996 | Krigmont | 96/54 |
| 5,547,496 | A | * | 8/1996 | Hara | 96/79 |
| 5,938,818 | A | | 8/1999 | Miller | 95/63 |
| 6,152,988 | A | * | 11/2000 | Plaks et al. | 95/58 |

FOREIGN PATENT DOCUMENTS

| | | | | |
|---|---|---|---|---|
| JP | 54-158770 A | * | 12/1979 | 96/97 |

* cited by examiner

*Primary Examiner*—Richard L. Chiesa
(74) *Attorney, Agent, or Firm*—Clifford Kraft

(57) ABSTRACT

A multi-stage particulate matter collector of the type used to collect particles from waste industrial gas. The collector can contain multiple narrow and wide zones formed by a plurality of parallel corrugated plates. Contained in the narrow zones are elongated electrodes with sharp leading and/or trailing edges. These electrodes provide a non-uniform electric field near their sharp edges leading to corona discharge. The corona discharge causes particulate matter in the gas flow to become charged. The region in narrow zones away from the sharp edges of the electrodes resembles a parallel plate capacitor with relatively uniform electric field. In this region, particles can be collected on the plates and on the electrode. Wide regions can contain barrier filters (bag filters) with conductive surfaces. The electric field is also relatively uniform in this region causing electrostatic collection on the plates and filter surface. Gas exits the array through the sides of the barrier filters which provides additional highly efficient filtering.

28 Claims, 9 Drawing Sheets

MULTI-STAGE PARTICULATE MATTER COLLECTOR

BACKGROUND

1. Field of the Invention

This invention relates generally to the field of particulate matter collection from discharge gases and more particularly to a multi-stage particulate matter collector that collects both electrostatically and with barrier filters.

2. Description of Related Art

It is well known in the art how to build and use electrostatic precipitators. It is also known how to build and use a barrier filter such as a baghouse. Further, it is known how to charge particles so that these charged particles may be collected in a barrier filter with lower pressure drop and emissions than uncharged particles collected at the same filtration velocity.

Prior art designs have been discussed in the U.S. Pat. No. 5,547,493 (Krigmont), U.S. Pat. No. 5,938,818 (Miller), U.S. Pat. No. 5,158,580 (Chang), and U.S. Pat. No. 5,024,681 (Chang). Krigmont teaches a new precipitator electrode design/configuration, while the Miller and Chang deal with a combination of a precipitator or electrostatic augmentation and a barrier filter (fabric filter or a baghouse).

An electrostatic precipitator typically consists of two zones: 1) a charging zone where the dust or aerosol particles are charged, usually by passing through a corona discharge, and 2) a collecting zone where the charged particles are separated and transferred from the gas stream to a collecting electrode with subsequent transfer into collecting or receiving hoppers/bins.

The arrangement of these zones has led to two typical prior art precipitator design concepts: a conventional electrostatic precipitator where both zones are combined in a single-stage, and a so called two-stage design where the zones are separated.

Particulate matter found in waste gases from industry and power plants (hereinafter called by the generic term "dust"), can have various electrical resistance depending on temperature, humidity and other environmental factors. In particular, the resistance of fly ash depends on gas temperature, gas composition (especially moisture and sulphur trioxide), as well as various other coal or ash properties. Resistance is the result of a combination of surface and volume resistivity. Dust is considered to have high resistance when the particulate resistivity is over about $10^{11}$ ohm-cm. Dust is considered to have a low resistance when the particulate resistivity is lower than about $10^4$ ohm-cm.

The electrostatic precipitation process, in the case of high-resistance dusts, results in some reverse ionization at the side of the collecting electrode at which the dust accumulates. As a result, positively charged dust particles may be released or formed by such reverse ionization, and naturally such positively charged particles are repelled from, and not attracted to, the positively charged dust-collecting surface. As the gas stream passes between the "conventional" dust-collecting electrodes, particles which pick up a positive charge by reverse ionization near to a collecting electrode tend to move toward the next discharge electrode where they may pick up a negative charge. They may then move toward the collecting electrode where they may again pick up a positive charge, etc. The result is a zigzag motion where the particles are not collected.

In the case of low resistance dust, a somewhat similar process takes place; however, due to the entirely different phenomena. Low resistance dusts are known for a quick discharging; thus they would be repelled back into the gas stream almost instantly upon contacting the collecting plates, irrespective of their polarity.

Viewed as a statistical phenomenon, therefore as stated, particles of dust tend to move in a zigzag fashion between the plane of the discharge electrodes and the collecting electrodes spaced from them as the gas entrains such particles along the collecting path. The zigzag movement is a phenomenon which is associated with both high and low resistance dusts.

Because of the zigzag phenomenon, the effectiveness of dust collection is reduced, and the performance of a dust-collecting or dust-arresting assembly will be substantially lower for high or low resistance dusts than with dust with a the normal resistance range (particulate resistivity between $10^4$ and $10^{11}$ ohm-cm).

Krigmont in U.S. Pat. No. 5,547,493 describes an electrostatic precipitator, which utilizes a unique electrode design that provides for separate zones for aerosol particles charging and collection. The dust collecting assembly is a system of bipolar charged surfaces that are constructed in such a way that they provide alternate separate zones for high-voltage non-uniform and uniform electrostatic fields. The surfaces of the electrodes allow combining the charging and collecting zones with non-uniform and uniform electric fields respectively in one common dust arresting assembly. The disadvantage of this design is that it is entirely electrostatic allowing some of the particulate matter to make it past all the electrodes without being collected, especially in the case of high and/or low resistance dust.

Barrier filters (known as baghouse filters) are an alternative to electrostatic collection. They are generally bags through which the gas is made to pass. Conventional designs can be categorized as low-ratio baghouses (reverse-gas, sonic-assisted reverse-gas, and shake-deflate) which generally operate at filtration velocities of 0.76 to 1.27 centimeters per second (1.5 to 2.5 ft/min), also defined as air-to-cloth ratio or volumetric flow rate of flue gas per unit of effective filter area (cubic feet of flue gas flow/min/square foot of filtering area), and high-ratio pulse-jet bag-houses which generally operate at 1.52 to 2.54 centimeters per second (3 to 5 ft/min). Bag-houses generally have very high collection efficiencies (greater than 99.9%) independent of flyash properties. However, because of their low filtration velocities, they are large, require significant space, are costly to build, and unattractive as replacements for existing precipitators. Reducing their size by increasing the filtration velocity across the filter bags results in unacceptably high pressure drops and outlet particulate emissions. There is also potential for "blinding" the filter bags—a condition where particles are embedded deep within the filter and reduce flow drastically.

In a barrier filter, the particulate dust is collected on the outside surfaces of the bags while the flue gas passes through the bag fabric to the inside, where it exits through the top or bottom of the bags into a clean air plenum and subsequently out the stack. Cages are installed inside the bags to prevent them from collapsing during the normal filtration process. In pulsejet filters air nozzles are installed above each bag to clean the bag. By applying a quick burst of high-pressure air directed inside the bags, the bags are cleaned. This burst of air causes a rapid expansion of the bag and momentarily reverses the direction of gas flow through the bag, which helps to clean the dust off the bags.

Because of the small bag spacing and forward filtration through the two rows of bags adjacent to the row being cleaned, much of the dust that is removed from one row of bags is simply recollected on the adjacent rows of bags. Thus, only the very large agglomerates of dust reach the hopper after the burst of air through the bags. This phenomenon of redisbursion and collection of dust after bag cleaning is a major obstacle to operating prior art bag-houses at higher filtration velocities.

What is badly needed is a particulate collection system that has the high collection efficiency of a barrier filter along with the high filtering velocity of an electrostatic precipitator.

SUMMARY OF THE INVENTION

The present invention is a multi-stage particulate collector that can also be called an electrostatic precipitator even though it may also contain barrier filters.

A multi-stage collector assembly can be made up from discharge electrodes placed between oppositely charged (collecting) electrodes. Each of the discharge electrodes can form two zones: 1) a charging zone and a collection zone. This can be accomplished by using a sharp or pointed leading or trailing edge (or both) on the electrode. This edge can be formed as a discharging part by being provided with sharp edges or thorns where a corona discharge can be generated. The subsequent portion of the electrode can form a flat surface generally parallel to the collection electrodes to first, create a uniform electric field, and second, to form a collection surface for reversely polarized (charged) dust resulting from either reverse ionization (back corona) or purposely bipolarized dust. Charging takes place from a corona discharge at the leading and/or trailing edge of the discharge electrode.

The array can be made from a plurality of corrugated plates where the corrugations on pairs of adjacent plates form alternating wide zones and narrow zones (the distance between the plates in the narrow zones being less than in the wide zones). The dis charge electrodes can be located in the narrow zones and can simply be flat plates or shaped structures of various types. These plates or structures are elongated and generally run the length of the narrow zones in a lateral direction (which will hereinafter be called the vertical direction—it should be noted that it is not necessary that this direction be perpendicular to the earth for the functioning of the invention; rather any direction will work). The gas flows between pairs of these corrugated plates horizontally, perpendicular to the vertical elongated direction of the electrodes (from the end, the gas flow around the electrode would resemble the 2-dimensional flow of air around an airplane wing). If a thicker structure is used as an electrode, a sharp or pointed leading or trailing (or both) edge can be provided as the actual discharge point.

The discharge electrodes can be followed by a barrier filter element located in the wide zone placed between the collecting electrodes along the flow and extending vertically. The barrier filter can be exposed to the direction of flow of the gas, and parallel to the collecting electrodes which are plates. The discharge electrodes and barrier filter elements between each pair of plates can lie in a planar array so that the plane of the array is parallel to the direction of flow of the gas stream and to the collecting electrodes. According to the invention, the surface of the barrier filter can be made conductive.

The corrugated plates are held at a first electrical potential while the discharge electrodes and the conductive surface of the barrier filter are held at a second electrical potential. There is generally a high potential difference or voltage between them. Both the flat sides of each of the discharge electrodes and the surfaces of the barrier filter elements form collecting surfaces where the electric field is relatively uniform.

The surfaces of the conductive barrier filters are formed with electric field forming parts that may be suitably rounded and convex in the direction of the plate collecting electrode. As stated, the corrugated plate collecting electrodes are formed with "flat" (narrow) and "round" (wide) sections to accommodate both the discharge electrodes and barrier filter elements. Even though they are being described as "flat", their surfaces may be curved. It should be noted that it is preferred to use barrier filters with electrically conductive surfaces; however, it is also within the scope of the present invention to use non-conductive barrier filters with all electrostatic collection taking place predominantly in the narrow zones. Even in this case, because the bags are under relatively lower or ground potential, a portion of dust may be still collected on charged corrugated plates in wide zones as well.

By using an electrode with a cross-section that is relatively wide and thin, a uniform electric field can form in the region of the center of the electrode, and a non-uniform field of high intensity can form at the sharp leading and/or trailing edge. At sufficiently high field strength in this non-uniform field region, a corona discharge can take place between the electrode and the plates acting as an ion charging source for dust particles passing through it. The center region of uniform field on the other hand acts in a manner similar to the field between parallel capacitor plates with charged dust particles collecting on the plates.

More specifically, the dust particles near the corrugated arresting or collecting plate electrode which have been charged to a positive polarity by the positive ions resulting from reverse ionization are conveniently collected by the uniform field-forming part of the discharge electrode. Meanwhile, the dust particles around the discharge part (i.e. in the region of the corona-generating means) which are charged to negative polarity are caught by the collecting electrode. The foregoing assumes that the plate collection electrodes be at a relatively more positive (opposite) polarity than the discharge electrodes. Alternate polarities and AC sources are within the scope of the present invention.

The spacing between the discharge points (corona sources) and collecting surfaces are different, wider in the charging or corona generating zones and narrow in the collecting ones where a uniform high voltage electric field is required. This feature allows for the use of a single high voltage power source for all electrostatic fields (in all zones). A high voltage electric field of an adjustable (variable) frequency and/or alternating polarity could also be applied to the dust arresting assembly to further improve collecting efficiency of bipolar charged aerosol onto the surfaces of both plates, thus, substantially increasing the effective collecting area. It should be noted that even though the preferred method is to use a single voltage power source, it is within the scope of the present invention to use multiple voltage power sources.

The zigzag flow of dust particles attributable to reverse ionization is greatly limited, and the performance of the dust-arresting assembly is significantly improved so that high resistance dusts with which reverse ionization is a particular problem, are intercepted with high efficiency.

The present invention can be broadly summarized as a system in which multiple stages are utilized, with each stage performing a primary function, and the multiple stages operating synergistically to provide significantly improved overall results.

The principal objective of the present invention is to substantially improve fine particulate collection by combining both electrostatic charging/collection and filtration processes, not only by separating zones for particle charging and collecting, but, by providing a new unique collector design with improved efficiency to collect high resistance fine dust particles.

The present invention utilizes an upstream stage comprised of a generally conventional electrostatic precipitator apparatus of the type utilizing a series of corona generating points and accompanying collector plates followed by a downstream zone comprised of the generally parallel surfaces creating uniform electric field, followed by yet another stage which incorporates barrier filter the conductive surfaces of which provide a generally uniform electric field. In this manner, although all zones can be powered by a single power source, each can be designed to generally independently control electric field at an appropriate level. Moreover, by providing continuously repeated stages in series, the downstream zones effectively charge and collect the particles that are either uncollected or re-entrained and collect those particles after they have been charged.

Accordingly, it is an object of the present invention to provide a method and an improved multi-stage collector apparatus, comprising of an ion generating means for introducing unipolar ions into the gaseous effluent, a means for generating a uniform electric field in the regions between the flat surfaces, and the barrier filter means where the medium is flowing through its porous surface. The barrier filter can be made of a conductive porous fabric or ceramic to create yet another zone of uniform electric field. The fabric itself can be conductive, but more likely there is either a conductive surface on the fiber, or conductive fibers (such as carbon) are embedded or entwined in the fiber.

A further object of the present invention is to provide a multi-stage collector apparatus wherein the "uniform-field" regions have a high uniform electric field and wherein the ion current density in the "uniform-field" regions can be sufficiently small to control back corona without any penalty in the reduction of the average field and still be sufficient to hold collected particles to the collecting plates prior to removal of the particles from the collecting plates.

Another object of the present invention is to provide an improved collector apparatus, which incorporates an ion generating means and uniform electric field generating means that have an improved corona discharge apparatus within it.

Yet another object of the present invention is to provide an improved multi-stage collector apparatus that includes a downstream region that utilizes an improved barrier filter means which with the collector apparatus achieves superior operating results in terms of power efficiency and overall fine particle removal from the gaseous medium.

Still another object of the present invention is to provide a novel means for reducing back corona in localized areas within precipitating apparatus of the above type.

A further objective of this invention is to provide an improved multi-stage collector design, which avoids the problems of earlier systems and allows for increased efficiency in removal of sub-micron dusts and aerosols with reduction of required collecting surface.

It should be understood that the invention is not necessarily limited to the particular embodiments illustrated herein.

DESCRIPTION OF THE INVENTION

Figure 1:
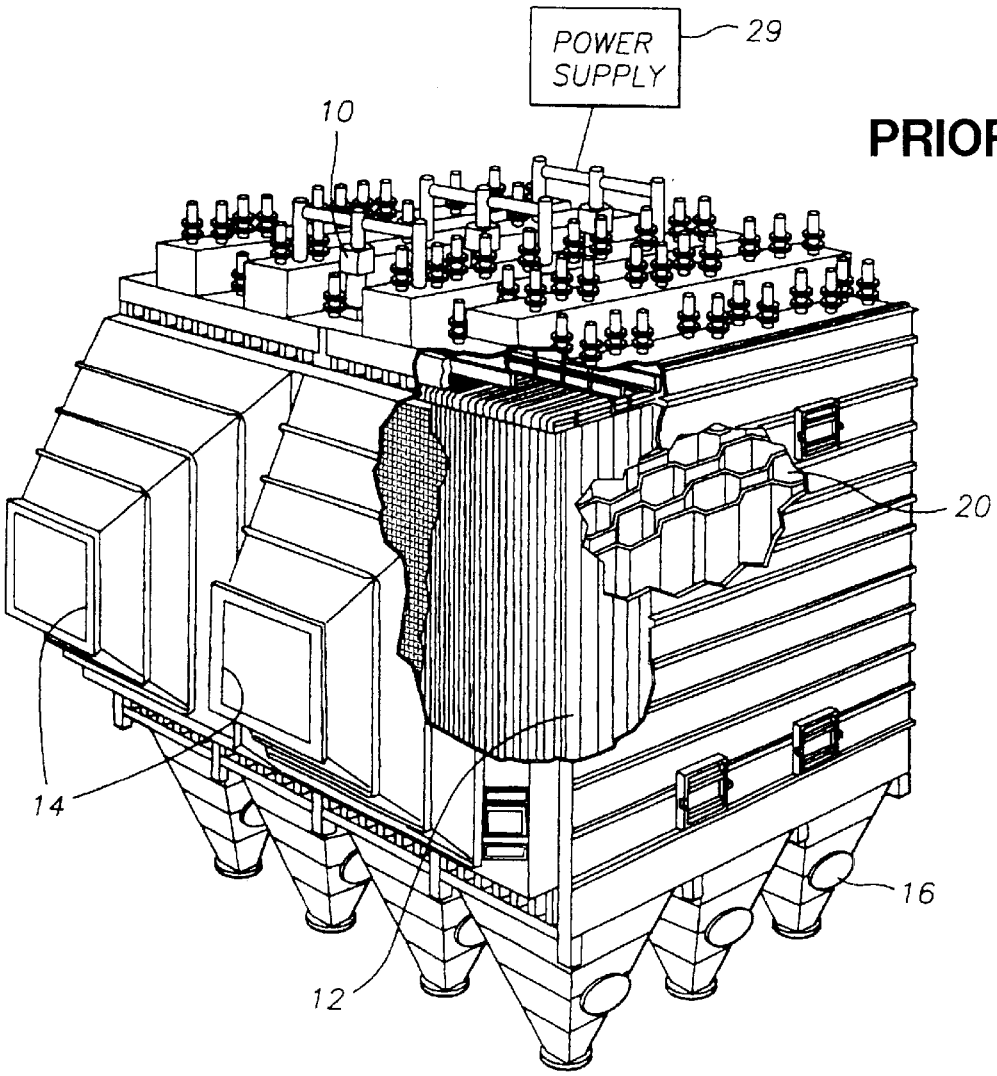
PRIOR ART FIG. 1
FIG. 1 shows a prior art electrostatic precipitator. The present invention can resemble such a unit with the improved techniques described herein.

Turning to FIG. 1, a prior art electrostatic precipitator is seen. A power supply 29 powers pairs of corrugated plates separated to form zones. Effluent gas enters the assembly from ports on the side 14 and passes through exiting on the other side (not shown). When the plates are rapped to clean, the collected dust falls to hoppers in the bottom where it can be removed 16. The array assembly 12 shown in detail in 20 is simply the plate corrugations of the alternately positive and negatively charged plates.

The present invention can be fitted into a similar assembly as that shown in FIG. 1 as will be described.

Figure 2:
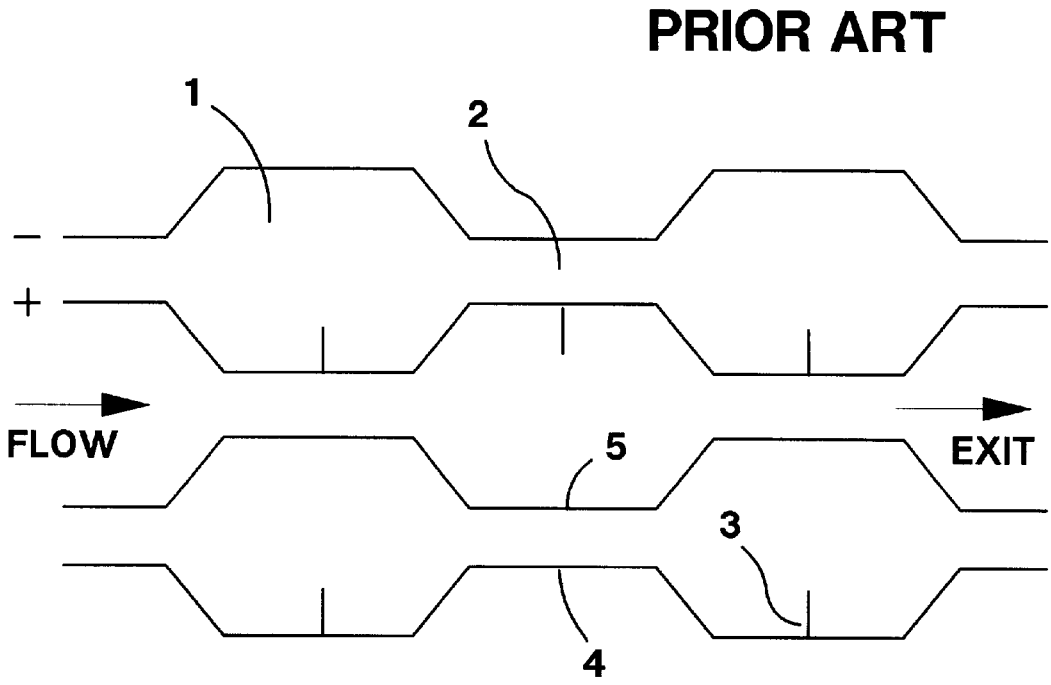
FIG. 2 shows a prior art electrostatic precipitator array.

FIG. 2 shows a pair of the corrugated plates 4, 5 from the prior art assembly of FIG. 1. Wide 1 and narrow 2 zones are seen. Electrodes 3 are attached to one of the plates and located in the wide zones 1 to produce a corona discharge.

Figure 3:
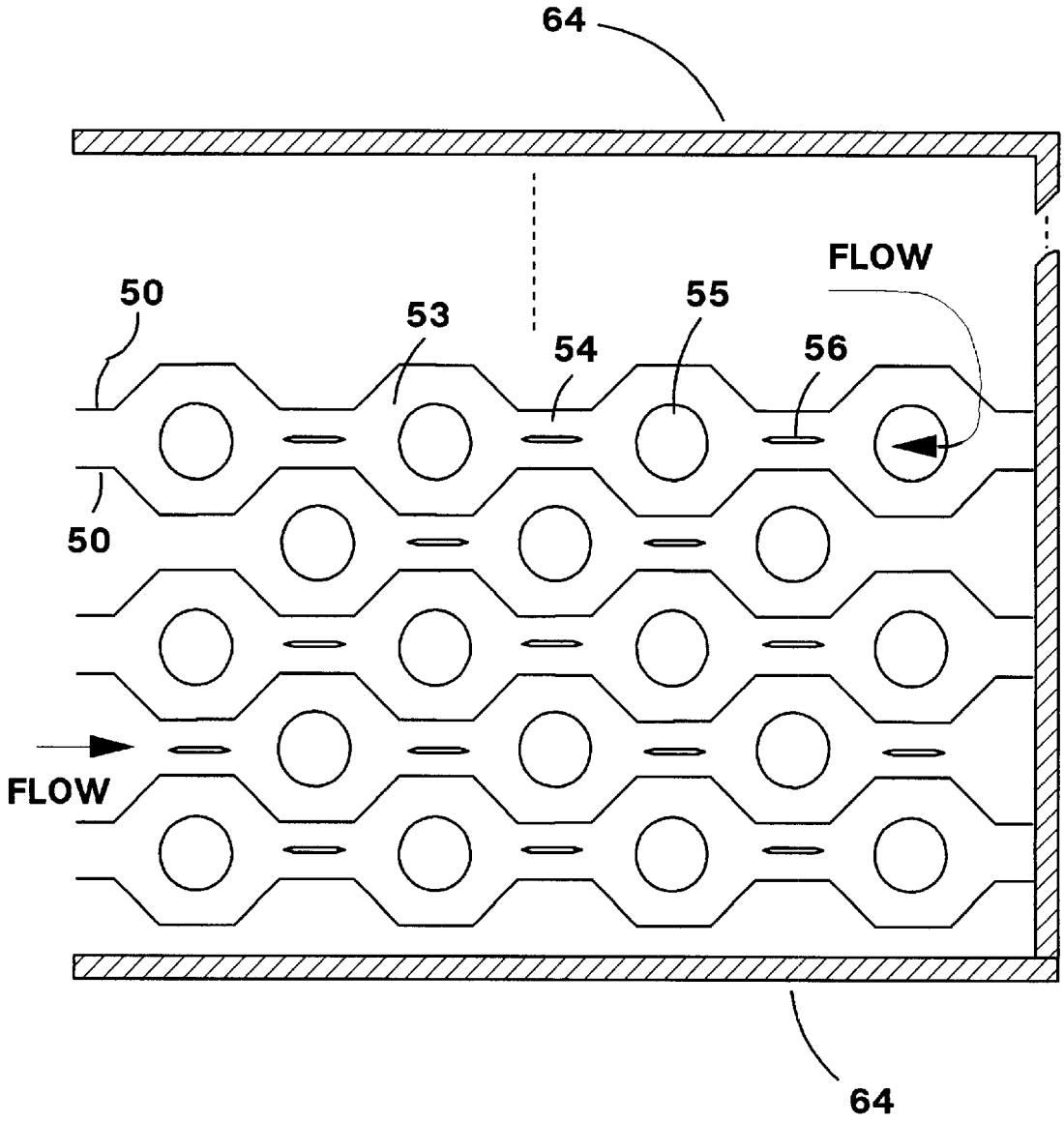
FIG. 3 shows an embodiment of the filtering array described by the present invention.

FIG. 3 shows an array that forms an embodiment of the present invention. A plurality of corrugated plate electrodes 50 form cells containing wide zones 53 and narrow zones 54. The plates 50 are positioned so that entering gas flows between them. However, in the present invention, the narrow zones 54 can each contain at least one flat, elongated (in the 3rd dimension, out of the paper) electrode 56 with sharp leading and/or trailing edges. The elongated electrode 56 is positioned in the gas flow so that the gas flows around it (like airflow around an airplane wing). The wide zones 53 can contain barrier filters 55 (shown as circles in FIG. 3) which can be conventional bag filters. However the surface of the barrier filters 55 of the present invention can be conductive. The gas flow shown in FIG. 3 remains between pairs of corrugated plates 50. The flow never crosses between regions defined by these pairs. The flow arrows in FIG. 3 are for illustration only.

The entire assembly shown in FIG. 3 is enclosed with a sealed end wall 64 preventing further flow of the gas in the direction parallel to the corrugated plates 50. Rather, the gas flow is between the plates and parallel to them with some of the gas exiting through the side of each barrier filter (bag) 55. The sealed wall 64 prevents further gas flow in the longitudinal direction of the plates and forces all gas to exit the assembly through the barrier filters 55 (the only exit).

Figure 4:
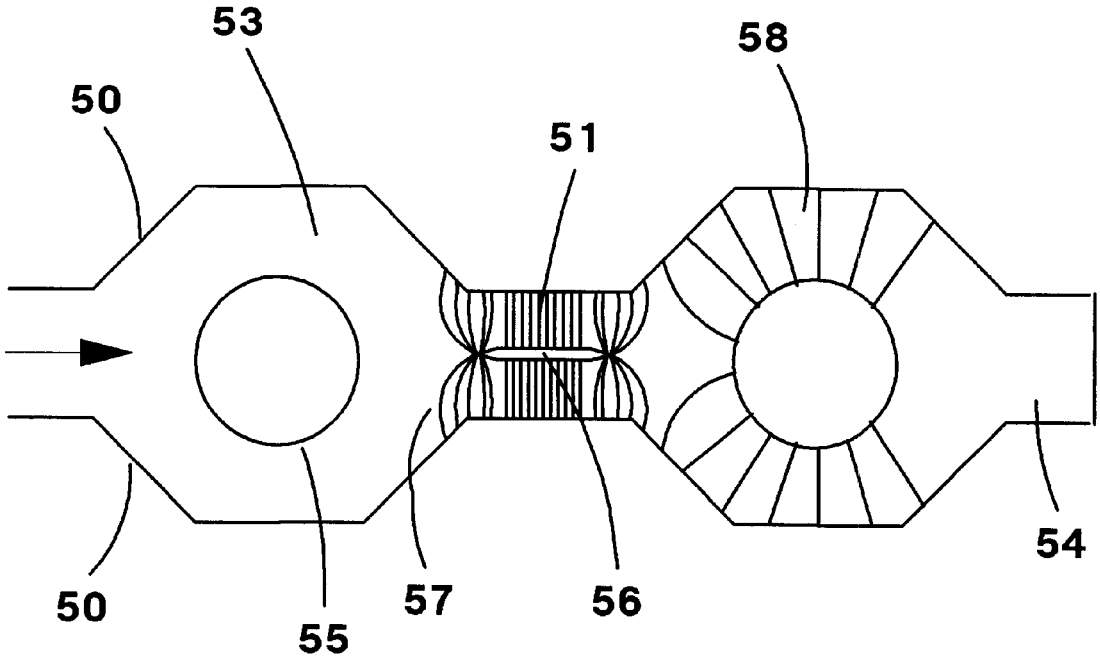
FIG. 4 shows a detail view of the electric field in the narrow and wide zones in the embodiment of FIG. 3.

Turning to FIG. 4, the operation of the present invention will now be explained. FIG. 4 shows zones formed by two of the parallel corrugated plates 50. The flat elongated electrode 56 and the barrier filters 55 can be clearly seen. The corrugated plate electrodes 50 are held at a first electrical potential, while the flat elongated discharge electrode 56 and the conductive surface of the barrier filter 55 are held at a second electrical potential. The preferred method of operation of the invention is to hold the elongated electrodes 56 and the surface of the barrier filters 55 at ground potential with a high voltage applied to the corrugated plates 50. However, it should be understood that the present invention can be operated at any potentials different enough to cause corona discharge at the sharp edges of the elongated electrodes at any polarities. In particular, the polarities can be reversed either statically or dynamically, or the apparatus can be operated with AC voltage applied. While the elongated electrodes and the barrier filters are usually operated at the same potential with respect to each other, this is not necessary. It is within the scope of the present invention to use a third potential and operate the elongated electrodes and the barrier filters at different potentials.

FIG. 4 also shows a partial depiction of the electric field in the narrow and wide zones. At the leading and/or trailing edges of the flat, elongated electrodes 56 the electric field 57 is non-uniform and is adjusted to cause a corona discharge from the pointed edge of the elongated electrode 56 to the corrugated plate 50. Thus, gas flowing toward the electrode 56 passes through a discharge of ions in the corona with dust particles becoming charged. The electric field 51 near the center of the flat elongated electrodes 56 is relatively uniform and resembles the field between the plates of a parallel plate capacitor. Charged dust passing through this narrow zone is collected either at the corrugated plate 50 or on the elongated electrode 56.

The electric field 58 in the wide zone is also relatively uniform and resembles the field between the plates of a concentric cylindrical capacitor. Particles entering this zone are collected electrostatically either on the surface of the corrugated plate 50 or electrostatically on the conductive surface of the barrier filter 55 or on the fabric or material of the barrier filter 55 by normal filtering action. The barrier filter 55 can be a fabric cloth bag, or can be a porous material such as a porous ceramic or metal. The barrier filter surface can also contain embedded catalysts for the removal of other materials such as mercury or other contaminants from the gas or for conversion (reduction, oxidation) of actual gas components. The surface of the barrier filter 55 can be made conductive with either a conductive layer or with impregnated conductive material or fibers.

Values of the electric fields in the various zones are around 6–13 kV/cm in the wide zones; the non-uniform field in the narrow zone can be around 2–6 kV/cm, and the uniform field in the narrow zone can be around 6–13 kV/cm. Of course with a given potential difference, and with the elongated electrodes 56 and the barrier filters 55 at the same potential, the uniform field in the narrow zones may be greater than the uniform field in the wide zones. The exact field strength in each zone will depend on the exact geometry and potentials used. The basic idea is that the voltage (potential difference) will be set to a value to cause the desired corona discharge from the discharge points. The geometry will be designed to achieve the desired uniform fields.

It should be noted that although the barrier filters 55 in FIGS. 3 and 4 are shown with circular cross-sections, any cross section is within the scope of the present invention that leads to a relatively uniform field in the wide zones. In particular, an elliptical cross-section can be used to increase the uniformity of the field in the wide zones and to increase the surface area of the barrier filter element for greater collection and filtering.

Figure 5:
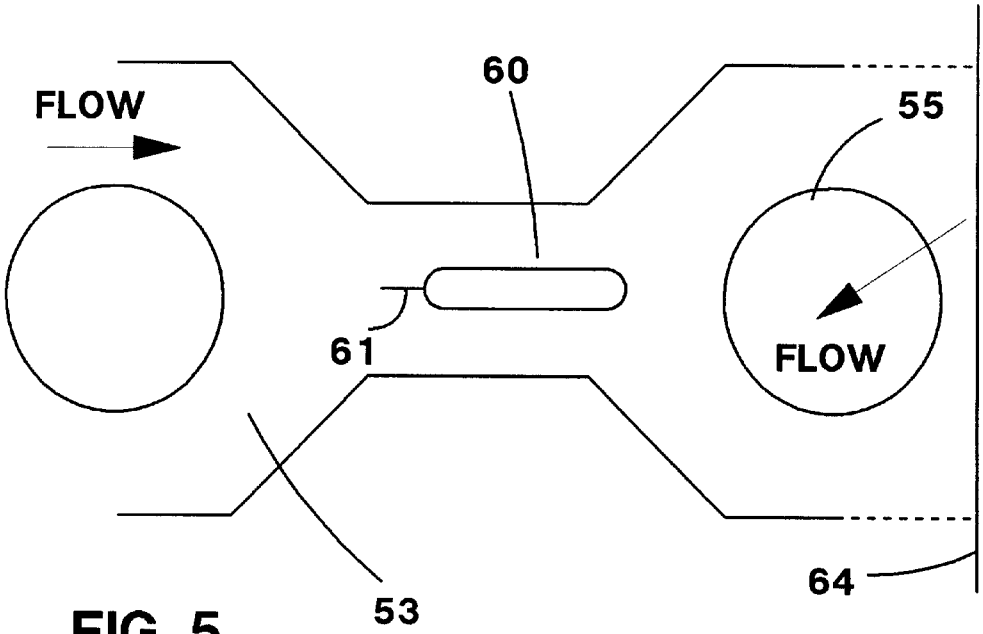
FIG. 5 shows details of a narrow zone with one type of electrode.
Figure 6A:
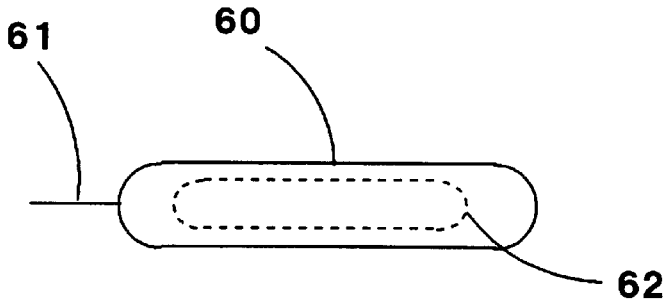
FIGS. 6A–6B show details of one embodiment type of a discharge electrode.
Figure 6B:
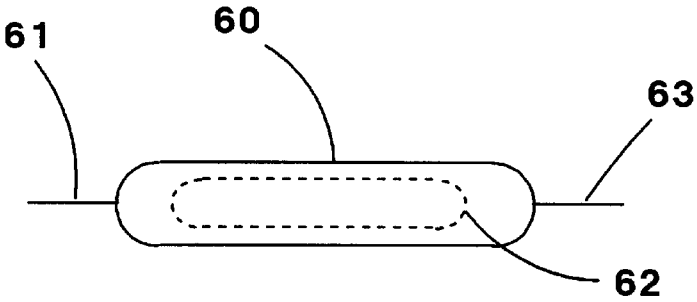

FIG. 5 shows one embodiment of a narrow and wide zone and of a particular cross-section and design 60 of the flat, elongated electrode (56 in FIGS. 3 and 4). In FIG. 5, the electrode 60 is elongated with a rounded front. Extending from the rounded front is a sharp thin plate or wire 61 which acts as the discharge point for the corona discharge. FIG. 6A shows the electrode 60 from FIG. 5 with the optional feature of a hollow core 62. FIG. 6B shows the same electrode 60 with two discharge points 61, 63 on a leading and trailing edge. It should be remembered that it is within the scope of the present invention to have discharge point(s) on leading and/or trailing edges of the electrode 60. Thus it is within the scope of the present invention to reverse left to right the embodiment of FIGS. 5 and 6A so that the discharge point 61 appears on the trailing edge. Also, the discharge points can take many different sharp or pointed geometric forms.

Figure 7A:
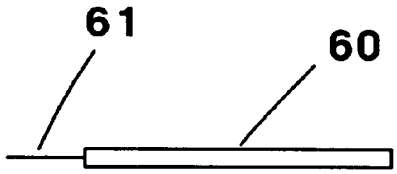
FIGS. 7A–7C show details of a different embodiment type of a discharge electrode.
Figure 7B:
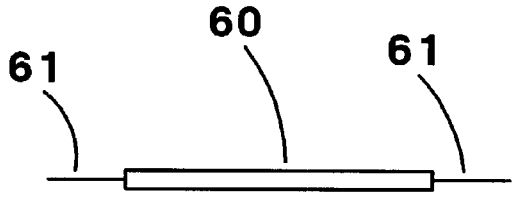
Figure 7C:
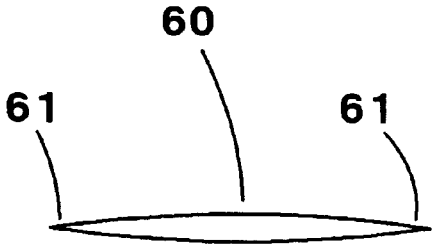

FIGS. 7A, 7B, and 7C show a different embodiment of the elongated electrode 60 in the form of a flat plate with a sharp leading edge 61, a flat plate with a sharp leading and trailing edge 61, and a contoured shape with sharp leading/or trailing edges. It is within the scope of the present invention to use just a very thin flat plate alone as the flat elongated discharge electrode.

Figure 8:
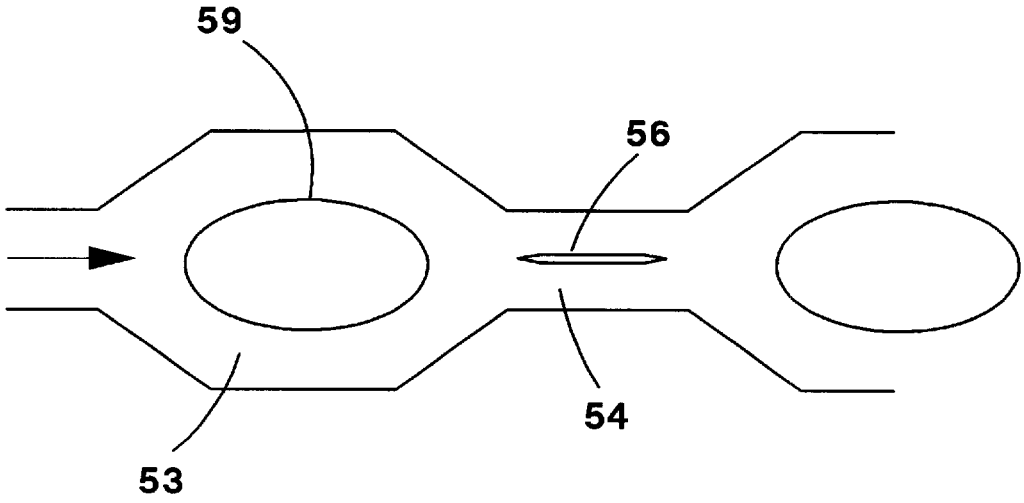
FIG. 8 shows a partial array where the barrier filters are elliptical.

FIG. 8 shows an embodiment of a wide 53 and narrow 54 zone with a plate type elongated electrode 56 and a barrier filter 59 with an elliptical cross-section. Any cross-section that yields a relatively uniform electric field in the wide zone 53 is within the scope of the present invention. It is possible to also use a standard non-conductive bag filter in some or all of the wide zones 53 with no or little electric field in these regions.

Figure 9:
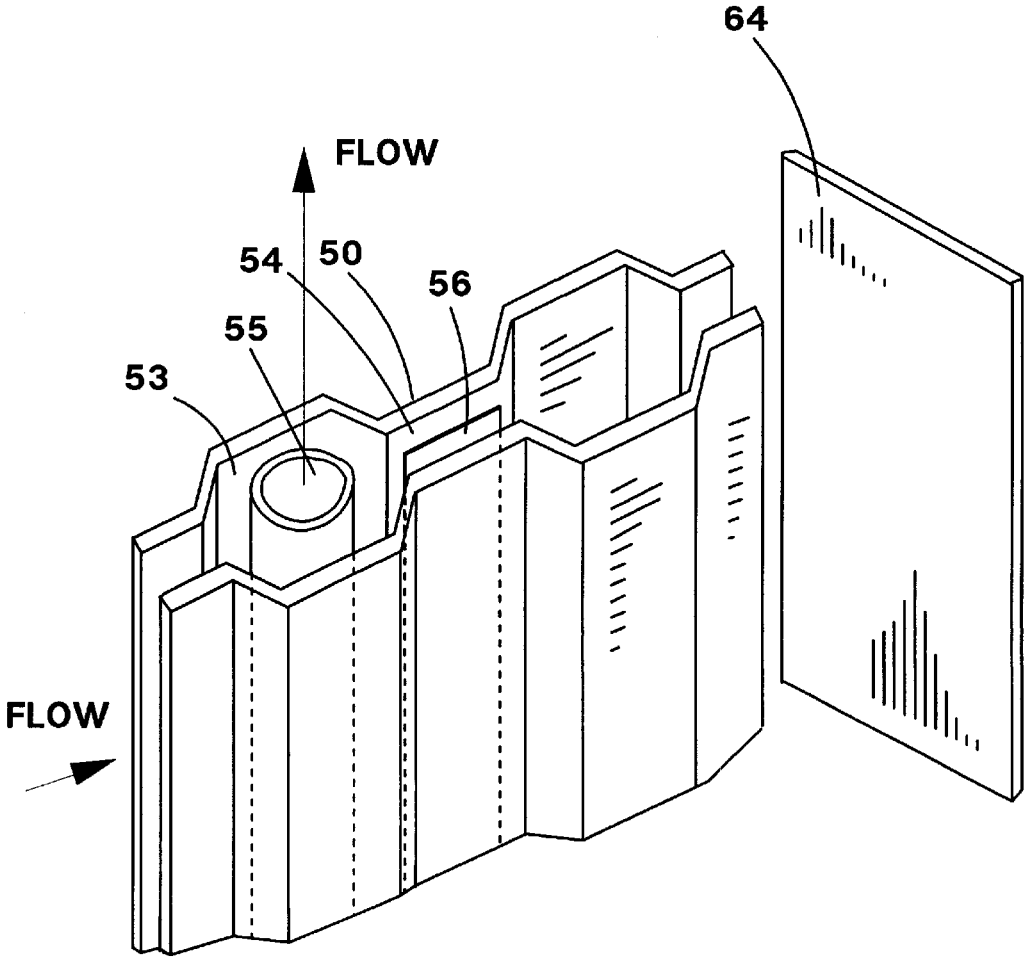
FIG. 9 shows a perspective view of a pair of corrugated plates forming narrow and wide zones with one discharge electrode and barrier filter shown.

Turning to FIG. 9, a perspective view is seen of a typical array formed by two of the plurality of corrugated plates 50. The wide zones 53 and the narrow regions 54 are clearly seen. The flat, elongated discharge electrode 56 is positioned in the narrow regions 54 and extends vertically the length of the zone. A barrier filter 55 is seen in the wide zones 53 also extending the length of the zones. It should be noted that while it has been stated that the barrier filter and the elongated electrode extend the length of the zone, this is not a requirement for the present invention. While it is preferred that they extend the length of the zone for maximum filtering, embodiments are possible where they are shorter or longer. A solid wall 64 is shown in FIG. 9. This wall closes off the horizontal flow and causes all the gas to exit the array through the barrier filters.

Figure 10:
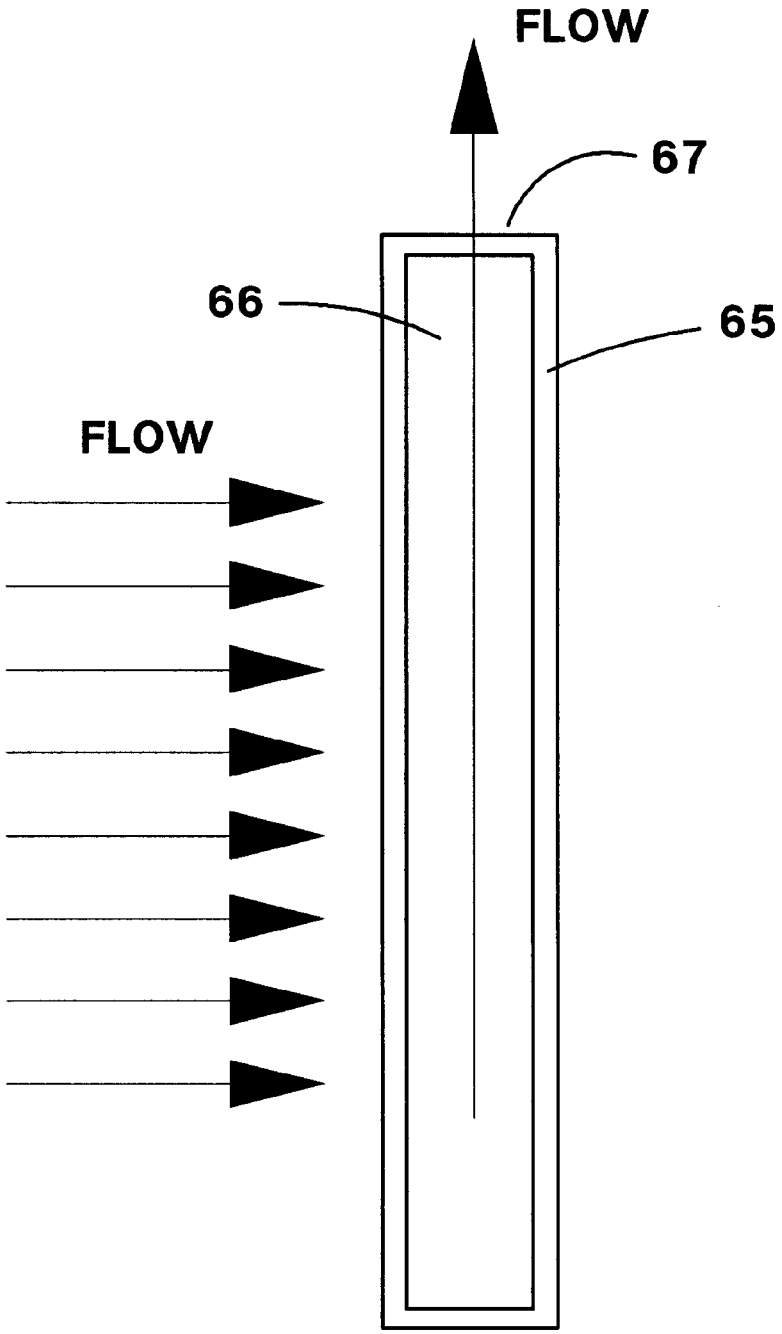
FIG. 10 shows a side view of a barrier filter depicting the gas flow through the side of the filter and out the top.

FIG. 10 shows a side view of a representative barrier filter. The surface of the filter 65 can be made of fabric or a porous material such as a porous ceramic or any other porous material. The surface 65 of the filter can be made conductive with a conductive layer, embedded conductive particles, or embedded conductive fibers. One type of conductive fiber is carbon. The gas flow passes through the side 65 and possibly the top or bottom of the barrier filter into the hollow center 66 and exits from the top 67 (or from the bottom). The conductive surface 65 and material of the bag should be such that there is good filtering action and also enough pass-through so that excessive back pressure does not build up in the flow. As previously stated, the surface of the barrier filter can also contain catalysts to perform actual chemical processing of other types of contaminants in the gas.

It should be noted that all collection surfaces can be cleaned in a conventional manner such as by rapping, polarity reversal, or by other means. The barrier filter bags, can be cleaned in a convention manner with pulsed air jets or by other means. Any means of cleaning the surfaces and/or bags is within the scope of the present invention.

It is to be understood that the above-described arrangements are merely illustrative of the application of the principles of the invention, and that other arrangements may be devised by those skilled in the art without departing for the spirit and scope of the invention.

I claim:

1. An electrostatic precipitator for removing particulate matter from a gas stream, said gas stream flowing through said precipitator, comprising, in combination:

a plurality of spaced pairs of corrugated plate electrodes, each of which extends in the direction of the flow of the gas stream and are spaced from each other transverse to the flow direction, said electrodes connected to a first electrical potential;

each of said pairs of corrugated plate electrodes forming a plurality of spaced alternating wide zones and narrow zones, the spacing extending in the flow direction;

each of said wide zones containing at least one electrically conductive barrier filter in communication with a gas outlet port, said conductive barrier filter being connected to a second electrical potential;

each of said narrow zones containing at least one relatively flat elongated electrode, said elongated electrode having a leading and a trailing edge with respect to said gas flow, said elongated electrode essentially parallel to said corrugated plate electrodes, said elongated electrode connected to said second electrical potential;

said first and second electrical potentials chosen to cause corona discharge from the leading and/or trailing edges of said elongated electrodes, said corona discharge extending from said elongated electrode to said corrugated plate electrodes.

2. The electrostatic precipitator according to claim 1 wherein said second electrical potential is electrical ground.

3. The electrostatic precipitator according to claim 1 wherein said first electrical potential is electrical ground.

4. The electrostatic precipitator according to claim 1 further comprising a difference in potential between said first and second electrical potentials causing electric fields in said narrow and said wide zones, said electric field in said wide zone being relatively uniform approximately in the range of 6 to 13 kilovolt/centimeter; said electric field in said narrow zone having a uniform and a non-uniform part, said non-uniform part being near said corona discharge; said non-uniform part approximately in the range of 2 to 6 kilovolt/centimeter, said uniform part approximately in the range of 6 to 13 kilovolt/centimeter.

5. The electrostatic precipitator according to claim 1 further comprising a power source used to produce said first and said second electrical potentials.

6. The electrostatic precipitator according to claim 5 wherein said power source is DC.

7. The electrostatic precipitator according to claim 6 wherein said DC power source can reverse polarity.

8. The electrostatic precipitator according to claim 5 wherein said power source is AC.

9. The electrostatic precipitator according to claim 1 wherein said barrier filter is a conductive fabric.

10. The electrostatic precipitator according to claim 1 wherein said barrier filter is a ceramic containing a conductive surface layer.

11. The electrostatic precipitator according to claim 1 wherein said barrier filter has a circular cross-section.

12. The electrostatic precipitator according to claim 1 wherein said barrier filter has an elliptical cross-section.

13. The electrostatic precipitator according to claim 1 further comprising a hopper located below said narrow and wide zones.

14. The electrostatic precipitator according to claim 1 further comprising a catalyst in contact with said barrier filter.

15. The electrostatic precipitator according to claim 1 wherein said relatively flat elongated electrode is hollow.

16. An electrostatic precipitator used to remove particulate matter from waste gas, the precipitator comprising a plurality of parallel plate corrugated electrodes positioned to form alternating sequences of wide and narrow zones, the gas flowing longitudinally between the plates through the two types of zones, the narrow zones containing flat elongated electrodes with sharp leading and trailing edges, the wide zones containing conducting barrier filters with the gas exiting the precipitator through the barrier filters; the flat elongated electrodes and the conducting barrier filters being connected to a first electrical potential, the corrugated plate electrodes being connected to a second electrical potential, a potential difference existing between the first and second electrical potentials, the sharp leading and/or trailing edges of the flat elongated electrodes providing source points for corona discharge that extends to the parallel plate electrodes, this corona discharge providing ions which attach to particles carried by the gas; the flat portions of the flat elongated electrodes positioned to form a relatively uniform electric field with the parallel plate electrodes causing charged particles to be trapped at surfaces of the flat elongated electrodes and/or on the parallel plate electrodes; the conductive barrier filter also forming a relatively uniform electric field with respect to the parallel plate electrodes further causing particles to be trapped at surfaces of the barrier filter and/or the parallel plate electrodes, the difference in potential chosen so that the uniform electric fields are small enough to control back corona and yet high enough to efficiently collect charged particles.

17. The electrostatic precipitator according to claim 16 wherein the potential difference is DC.

18. The electrostatic precipitator according to claim 17 wherein said DC potential difference can be reversed in polarity.

19. The electrostatic precipitator according to claim 16 wherein the potential difference is AC.

20. The electrostatic precipitator according to claim 16 wherein the barrier filter is a conductive fabric.

21. The electrostatic precipitator according to claim 16 wherein the barrier filter is a ceramic with a conductive surface layer.

22. The electrostatic precipitator according to claim 16 further comprising a catalyst in contact with said barrier filter.

23. A method of removing particulate matter from waste gas using an electrostatic precipitator with parallel conducting plates comprising the steps of:

causing waste gas containing particulate matter to pass through a plurality of alternating wide and narrow zones formed by corrugations in said conducting plates, each narrow zone containing at least one flat grounded electrode, each wide zone containing at least one grounded conductive barrier filter;

applying high voltage between said parallel conducting plates and said flat grounded electrodes causing a non-uniform electric field and corona discharge from leading and/or trailing edges of said flat grounded electrodes to said parallel conducting plates, and causing regions of relatively uniform electric field between areas of said flat ground electrodes between said leading and trailing edges where no corona discharge takes place;

applying high voltage between said parallel conducting plates and said conductive barrier filters forming regions of relatively uniform electric field between said conductive barrier filters and said parallel conducting plates;

causing said waste gas to pass through said corona discharge whereby said particulate matter accumulates charge;

causing said waste gas to pass through said regions of relatively uniform electric field whereby a portion of said particulate matter is trapped on surfaces of said parallel conducting plates and/or on said flat grounded electrodes and/or on said grounded conductive barrier filters;

causing said waste gas to exit through said barrier filters further trapping particulate matter.

24. The method of claim 23 wherein said barrier filters are conductive fabric.

25. The method of claim 23 wherein said barrier filters are ceramic with a conductive surface layer.

26. The method of claim 23 further comprising a catalyst in contact with said barrier filters.

27. The method of claim 23 wherein said regions of relatively uniform electric field are approximately in the range of 7 to 13 kilovolt/centimeter.

28. The method of claim 23 wherein said regions of non-uniform electric field are approximately in the range of 2 to 6 kilovolt/centimeter.

* * * * *